US005743400A

United States Patent [19]

Hansen et al.

[11] Patent Number: 5,743,400

[45] Date of Patent: Apr. 28, 1998

[54] CARRIER AND/OR CONNECTOR FOR A SERIES OF PACKAGES

[75] Inventors: Finn R. Hansen, Hønefoss; Björn Björge, Asker, both of Norway

[73] Assignee: Dalwell AB, Bäckefors, Sweden

[21] Appl. No.: 619,693

[22] PCT Filed: Sep. 30, 1994

[86] PCT No.: PCT/SE94/00902

§ 371 Date: Mar. 29, 1996

§ 102(e) Date: Mar. 29, 1996

[87] PCT Pub. No.: WO95/09781

PCT Pub. Date: Apr. 13, 1995

[30] Foreign Application Priority Data

Oct. 1, 1993 [SE] Sweden ..... 9303230
Aug. 18, 1994 [SE] Sweden ..... 9402766

[51] Int. Cl.[6] ..... B65D 71/00

[52] U.S. Cl. ..... 206/428; 206/431; 206/821; 220/23.4; 220/756; 229/117.23

[58] Field of Search ..... 206/139, 162, 206/427, 428, 431, 821; 220/23.4, 23.8, 23.2, 507, 519, 756; 229/117.09, 117.23, 117.26, 120.011, 120.11, 120.24–120.28, 931

[56] References Cited

U.S. PATENT DOCUMENTS

| | | | |
|---|---|---|---|
| 2,782,915 | 2/1957 | Fahringer | 206/431 |
| 2,819,793 | 1/1958 | Lamb | 206/431 |
| 3,080,965 | 3/1963 | Kuchenbecker | 206/431 |
| 3,221,876 | 12/1965 | Currie . | |
| 3,236,433 | 2/1966 | Barrett | 229/120.28 |
| 3,384,229 | 5/1968 | Kaschyk et al. | 206/431 |
| 4,210,241 | 7/1980 | Morcom | 229/931 |
| 4,213,529 | 7/1980 | Whitaker | 206/427 |
| 4,932,534 | 6/1990 | Focke | 229/120.011 |
| 4,946,037 | 8/1990 | Keith . | |
| 5,129,575 | 7/1992 | Bryan | 229/120.011 |

FOREIGN PATENT DOCUMENTS

| | | |
|---|---|---|
| 0060504 | 9/1982 | European Pat. Off. . |
| 154263 | 5/1986 | Norway . |
| 2170470 | 8/1986 | United Kingdom . |

*Primary Examiner*—Jimmy G. Foster
*Attorney, Agent, or Firm*—Davis and Bujold

[57] ABSTRACT

A carrying and/or uniting device (1), designed for mainly parallelepiped-shaped packages (4), having outer fastening tapes (8), provided with glue and designed to fasten the device onto a set of packages (49). The device is subdivided into plurality of longitudinal or horizontal sections (12, 14), which are separated from each other by means of folding indications, designed as perforations or the like and/or tearing-off tapes or the like (11, 16, 18). At least one of these sections is provided with one or several recesses (13) with a carrying and/or information function. The device is close to the tearing-off indication provided with transverse perforations (9) for dividing up and consequently detaching separate packages from a set of packages, which are united by a device. In accordance with the invention the applied device with the carrying function has a rhomboidal open shape. In order to make it less bulky and/or for other reasons the applied device can be folded up on itself with its four central sections (12, 14), which in their folded up condition contact each other or almost, at the same time as the total height of the device is reduced.

9 Claims, 4 Drawing Sheets

CARRIER AND/OR CONNECTOR FOR A SERIES OF PACKAGES

The present invention concerns a carrier and/or connector for a series of packages, e.g. milk, juice and the like.

During filling, handling and storage it is often advantageous to be able to handle a set of packages as a unit, time, spillage, costs etc. being saved in this way. This is true for the manufacturers, the distributors and the consumers of the marketed product. Also, it is an advantage, if such packages can be seized and carried in a way, which is simple, secure and advantageous for the rest, no expensive and complicated means being required for this purpose. Finally, it is an advantage, if one unit comprising several separate united packages at any time can be subdivided in an easy and simple fashion, by what means it will always be feasible to select and detach an arbitrary small number of packages from such a multiple unit. Also, the attachment of such devices to one or several packages has so for resulted in problems of various types. In order to be easy to be siezed a carrying and/or uniting device ought to protrude quite much from the corresponding packages. However, this has so far rendered storage, paricularly stacking, transportation and handling for the rest more difficult. To the extent that devices of this type already are known, they are impaired by at least some of the above-mentioned deficiences.

Known technique in this field is described in EP-A-2 060 504, U.S. Pat. No. 3,221,875, GB-A-2 170 470, NO-B-154 263 and U.S. Pat. No. 4,946,037, EP-A-2 060 504 being considered representing the state of the art the best. However, the handles according to this pulication require, provided a lateral handle positioning is not selected, which is disadvantageous because of bad carrying characteristics, a set of packages also in the transverse direction, between which lateral packages a V-shaped element must be introduced and glued onto package sides facing each other. The handles themselves have rather weak base sections and cannot be regarded as being easy to seize due to their flat shape with minor holes, through which individual fingers are to be introduced. Also, it may be difficult and time-consuming for persons who are not very deft with their fingers to lift the handles out of their adjacent cut out contour, where glue spillage below the handle portions may cause additional problems.

The object of the present invention is to provide a carrying and/or uniting device, designed for a set of packages, which device removes all the above-mentioned deficiences and results in all the desired advantages combined. The device is to be designed to meet ergonomical requirements and not only allow stacking of package sets provided with such devices on top of each other but facilitate such stacking and make the stacking promote the continued handling.

This object is attained according to the present invention by means of a carrying and/or uniting device of the type described in the introduction, which mainly is designed according to the characterizing clause of patent claim 1.

Additional characterizing features and advantages of the present invention till be set forth in the following description, reference being made to the enclosed drawings, which in more detail show a few not limiting, partially schematicly drawn embodiments:

Figure 1:
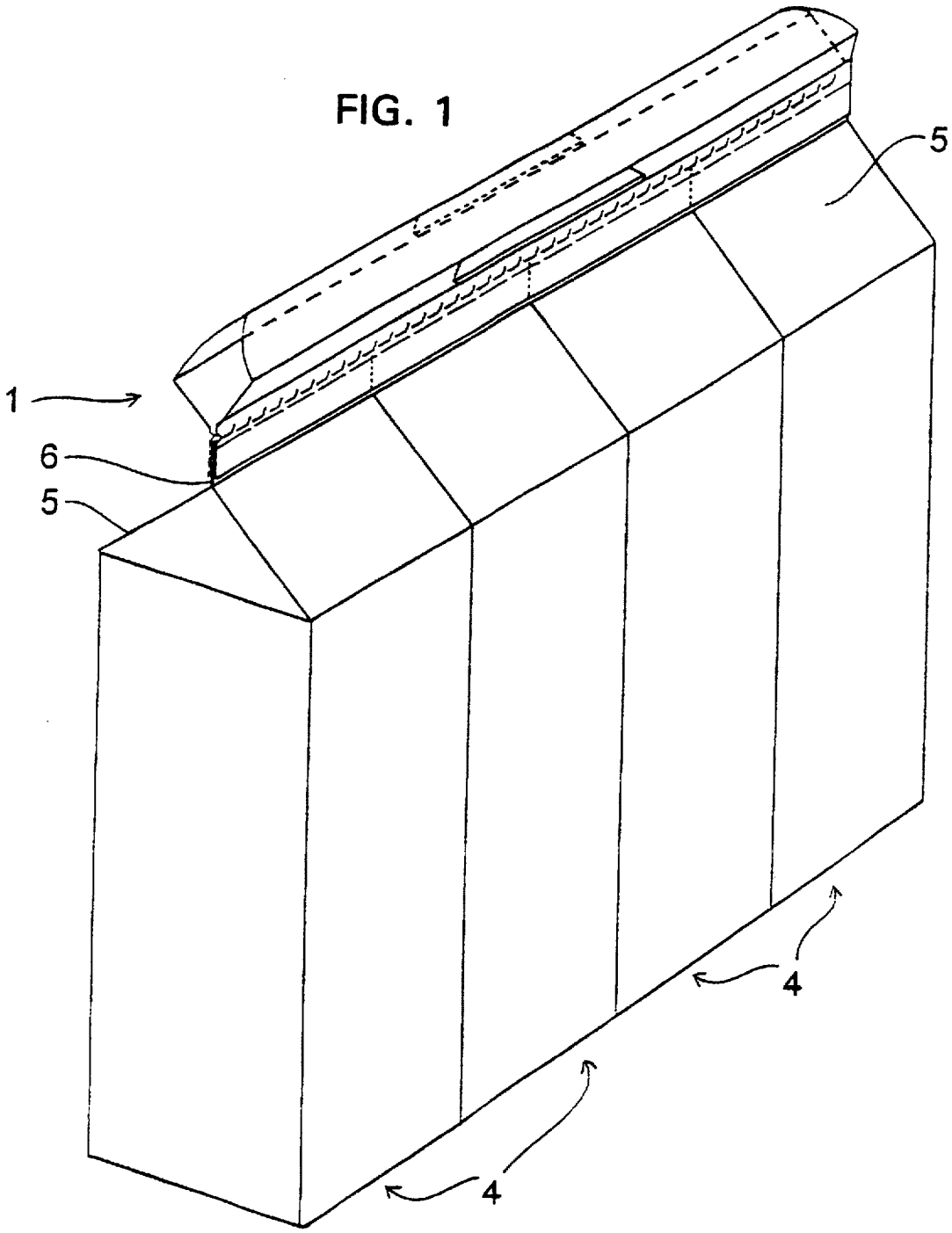
FIG. 1 is a partial perspective view of a set of packages, united by a carrying and/or uniting device according to the invention.
Figure 3:
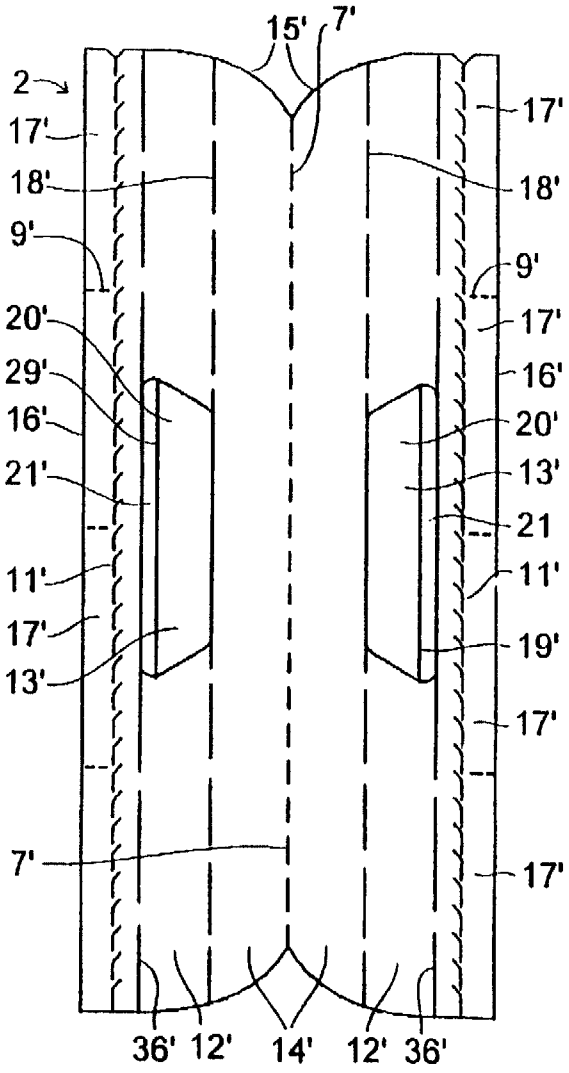
FIG. 3 is an alternative blank for a carrying and/or uniting device according to the invention in a planar view.
Figure 2:
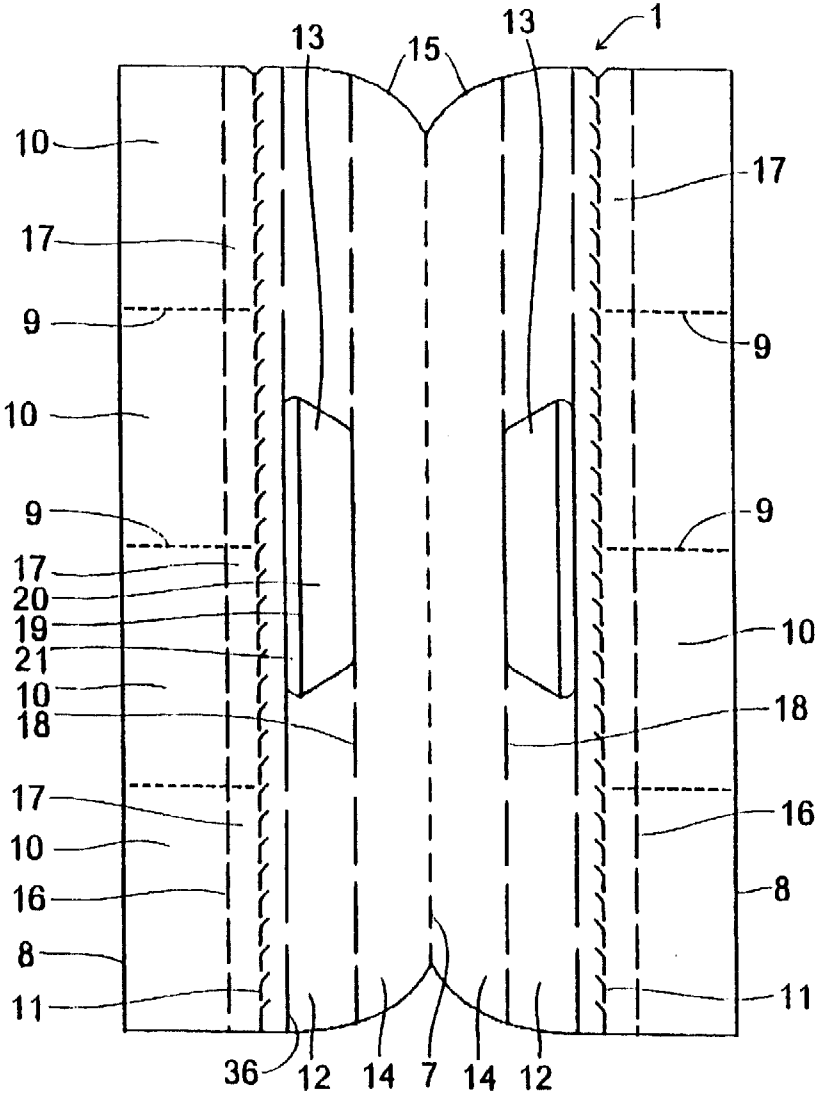
FIG. 2 is a planar view of a blank for a device according the invention, shown in FIG. 1.

In the drawings the same or similar parts are throughout provided with the same reference numerals. However, a device 1 according to the invention is shown in FIGS. 1 and 2, whereas a corresponding device 2 is shown in FIG. 3, 3 in FIG. 5 and 32 in FIG. 6. Mainly parallelepiped-shaped (gabled top) packages 4 are shown, which may have strongly convergent top surfaces 5, which along a central plane are joined to form a top flange or the like 6, which projects vertically upwards.

Figure 4:
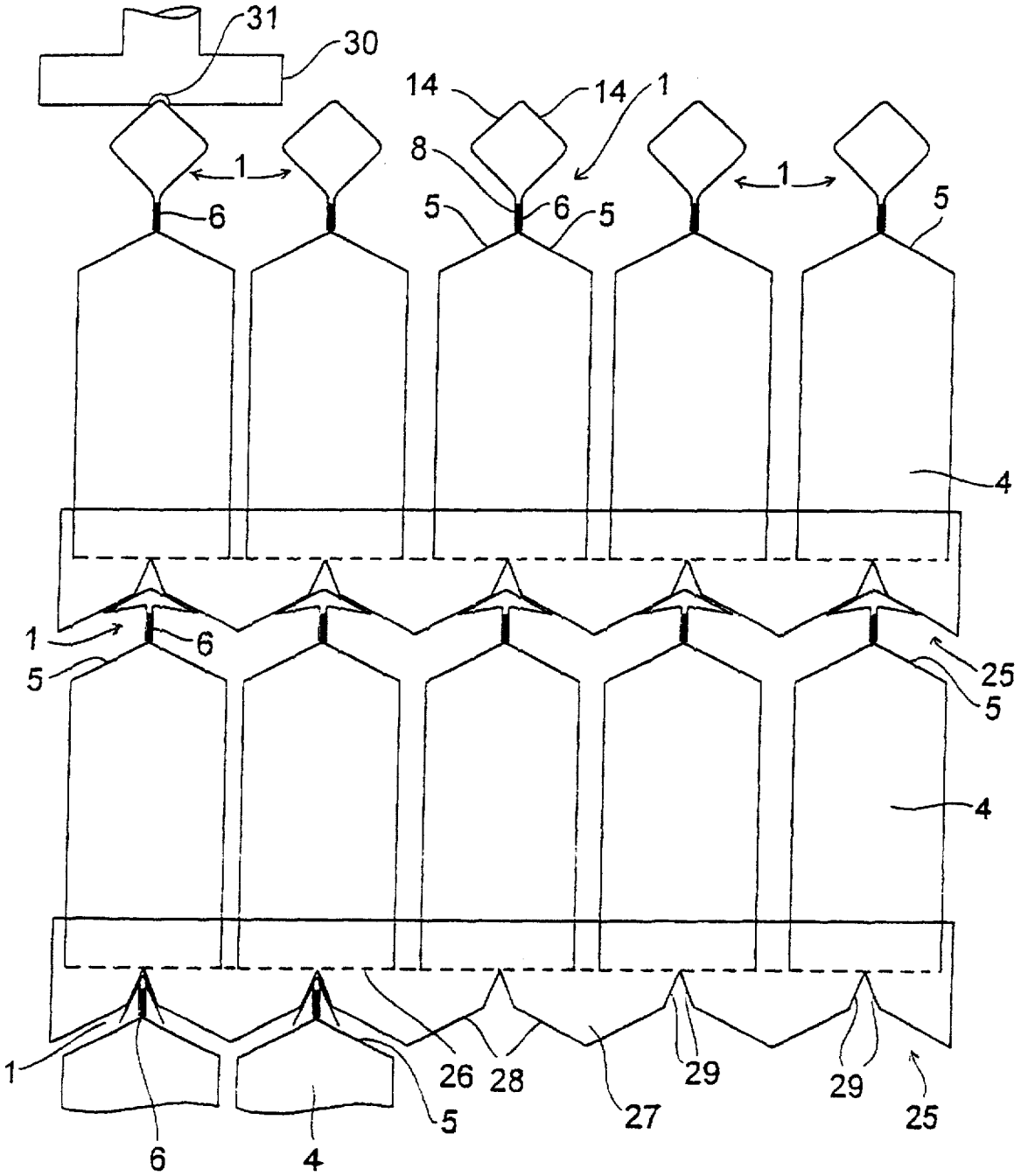
FIG. 4 shows a process of stacking package rows, devices and troughs according to the invention being used.

In accordance with the invention a set of e.g. four packages are placed in a row, the top flanges forming a common continuous flange, to which a carrying and/or uniting device 1 or 3 according to the invention is attached, preferably glued. What these devices have in common is that their length corresponds to the length of the row of packages. They comprise a blank, which is mirror-symmetrical along a longitudinal center line 7 and has lateral outer fastening tapes 8, which by means of transverse perforations or the like 9 are subdivided into sections 10, which correspond to the number of packages and their width in the longitudinal direction of the row. Said sections are limited towards the central line indirectly or directly by a tearing-off tape 11. Finally, there is in one 12 of the successive sections of the blank towards the center line one or several stamped holes 13. The center line itself suitably is a perforation line, and consequently it is easy to fold the blank accurately, which is shown in FIGS. 1 and 4. Sections 12 and 14 respectively which are directly connected to the center line are suitably slightly rounded at their ends 15.

In the blank according to FIGS. 1 and 2 a longitudinal perforation line 16 is connected to fastening tapes 8 and passes through transverse perforations 9. In this way small longitudinal sections 17 are formed, which allow a folding and/or a tearing-off along line 16 or the inwardly adjacent tearing-off tape 11, after which field 12 with hole 13 follows, which hole suitably is trapezoidal with rounded corners, the wide base suitably coinciding with the inwardly positioned longitudinal edge of tearing-off tape 11, whereas the trapezoidal top side coincides with a perforation line 18, which marks off section 12 from section 14 and constitutes a folding indication. Within hole 13 tongues 20 and/or 21 can, as an alternative to a complete material removal through stamping, remain, which are separated from each other by a stamping line 19, which runs parallel to the trapezoidal base and top respectively. A narrow and/or a wide flange can then be formed, which can be folded inwards or outwards in order to form a reinforcement for the carrying material around the hole and/or in order to function as a gluing tape to also maintain the folded parts of the blank in the desired positions. Where appropriate, and also generally in desired positions, an adhesive glue layer can be used, which of course already has been applied to the blank, when the latter has been fastened to the packages.

I is shown in FIG. 1, that the blank designed for the carrying function has a rhomboidal opened shape, where it is easy to reach said hole. It is then possible, in order to make the device less bulky and/or for other reasons, to fold up the upper parts of the blank according to FIG. 4, which suitably is initiated mechanically, when one or several package rows, in a machine (not shown) designed to apply devices according to the invention, has been provided with said devices by means of a plunger 30 having a positioning indication designed as a groove 31 in the lower side of the plunger, which is moved towards sections 14 and 12, which then or later will come in contact with each other or substantially so, the total height of the device being reduced. As an alternative said plunger or series of plungers can be used in connection with the stacking of the package rows, which is shown in FIG. 4. Thanks to such a compressing of the upright devices, which after the application in profile primarily have a long and narrow rhomboidal shape, a portion of the inner structurally elastic stress is removed and redistributed from the generally most strongly subjected area around the center line to the border line area between sections 12 and 14, a roughly rectangular profile shape according to the topmost row in FIG. 4 being obtained. By starting with such a partially stress-reduced shape with a redistributed inner elasticity in the material, it is later easier and securer to stack layers of packages provided with the devices on top of each other according to the following description.

It is also evident, that it is easy, in case this is desired, to detach an arbitrary number of packages by tearing these off jointly with flanges 10 and possibly 17 along perforations 9 and 16 or tearing-off tape 11, which latter consequently can be torn off only a certain distance in order to detach one or several packages. The various perforations and tearing-off tapes can of course be designed and function differently.

The design shown in FIG. 3 is similar to the design shown in FIG. 2, but it comprises no wide sections, but only narrow sections 17', which are fastened to flanges 6. In case wide sections 10 are provided, they can be attached to inclined top surfaces 5.

In FIG. 4 troughs 25 are shown, which have an upper recess 26 with a flat bottom designed to receive rows of packages provided with devices according to the invention. On lower side 27 the troughs principally have convergent surfaces 28, which correspond to top surfaces 5 and within the top area upwardly convergent guide grooves 29, which correspond to the folded up position of the devices according to the lowermost part of FIG. 4. The various sections 12,14 can in this way be increasingly compressed, which is shown by gradual stages in FIG. 4 from the top downwards. At the top is shown the shape, which the devices according to the invention have subsequent to the application onto the respective package rows. The shape can, in addition to the fastening as well as the described and shown perforations and/or grooves and/or bendings or the like, result from said prefolding downwards, during which process the plunger forces sections 14 downwards to roughly a flat shape jointly with sections 12. Subsequent to such a pressing downwards the elastic handle independently springs back to roughly the position shown uppermost in FIG. 4, which however subsequently facilitates the introduction of the devices into said guide grooves 29, at the same time as the devices are successively elasticly deformed according to the central and the lowermost parts of FIG. 4. In the lowermost position the compressed devices more or less fill up guide grooves 29, friction being generated, and additional security against unintentional displacements in a stack of pacakges and troughs in any direction being obtained. When later a trough is removed from a lower row of packages, the devices according to the invention independently expand due to their inherent elasticity into the shape, which is shown uppermost most in FIG. 4 and in which the devices easily and ergonomically accurately can be seized without having to straighten out the devices or treat them in any way. As is also shown in FIG. 4, the height of the devices is reduced between the uppermost and the lowermost positions shown substantially by halves, practically no reduction in storage and transportation space taking place in comparison with an array of such packages without devices according to the invention. Holes 13 are also designed in an ergonomically correct way and placed in the carrying function position of the devices. In the lowermost position in FIG. 4 convergent surfaces 28 of the trough can be placed at a small distance from the parallel top surfaces 5, which preferably are parallel, on the underlying packages or a direct contact is also possible according to what is desirable.

Figure 5:
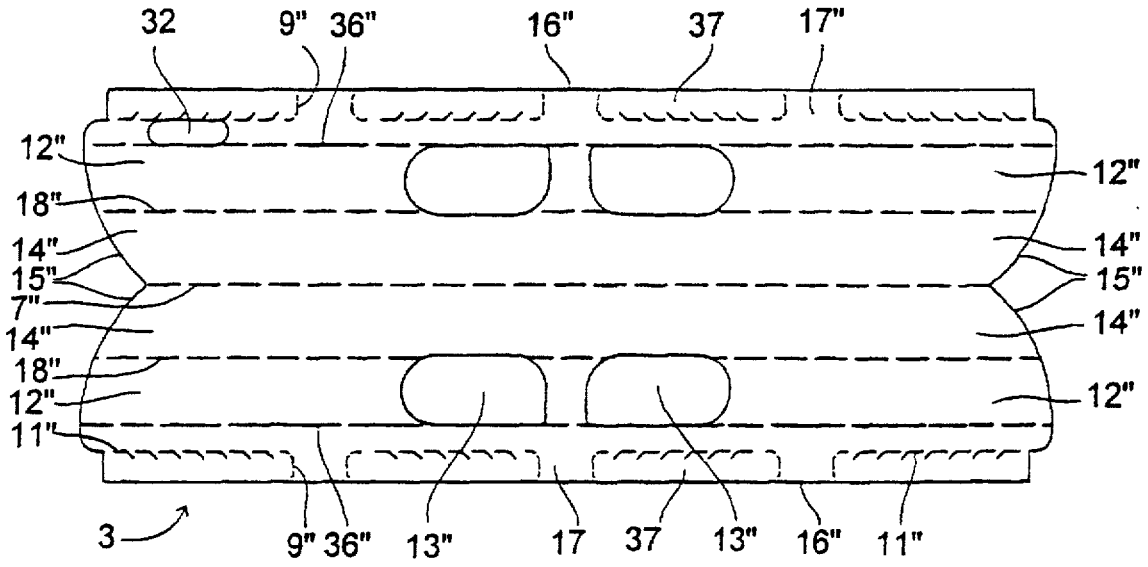
FIG. 5 shows an additional alternative blank for a carrying and/or uniting device according to the invention in a planar view.

FIG. 5 shows one embodiment, in which along each longitudinal side 16" fastening fields 37, which preferably are positioned at a small distance from each other, are arranged, which are separated from the adjacent material by perforations or the like 9". Device 3 is designed to be applied on e.g. four packages, the sides of which are provided with a continuous glue bead in those areas, which will be covered by said fastening field. The glue can then be heated or the like in order to adhere to the device and/or to set quickly. Other fastening processes can of course be used.

Within the upper left corner area the device is provided with a small window 32, in which a "use before"-date or other marking can be brought out.

For the rest the longitudinal perforations are designed to be used as folding indications. Instead of one continuous handle opening two openings 13" are used, which are placed at a distance from each other in the longitudinal direction.

Figure 6:
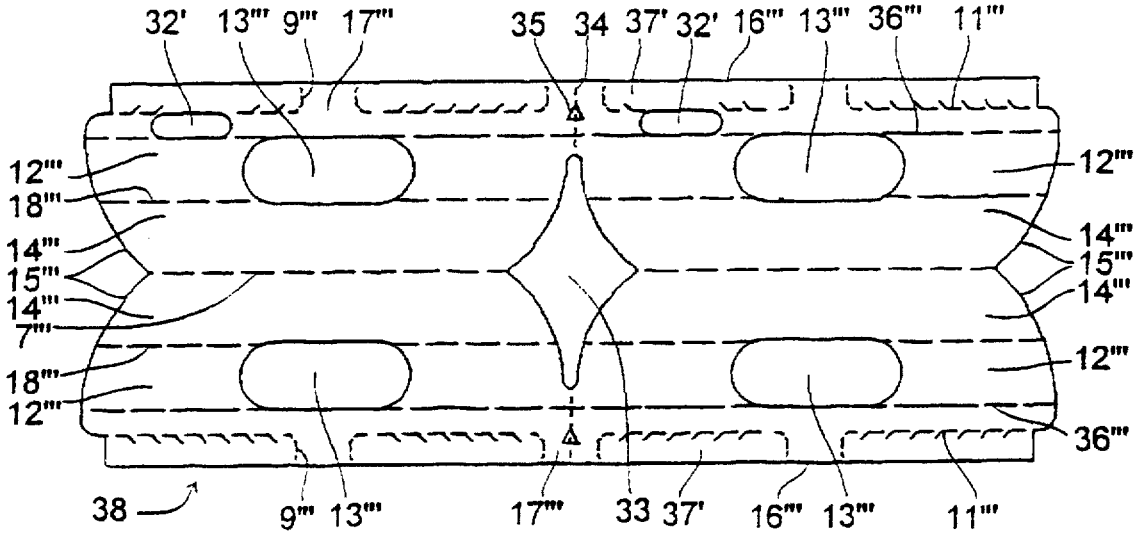
FIG. 6 shows an additional alternative blank for a carrying and/or uniting device according to the invention in a planar view.

FIG. 6 shows a device 38, which is similar to that shown in FIG. 5, but it has a central roughly rhomboidally shaped opening 33, designed to facilitate the tearing-off of the device in the transverse direction and/or longitudinal direction. In the transverse direction tearing-off-indications designed as arrows 35 and/or perforation cuts 34 can be used.

All embodiments can be provided with recesses or windows 32,32", which allow the observation of certain important pieces of information, e.g. a so called "to be used before"-date, set forth on the top flanges of the packages or the like.

The devices according to the present invention will preferably be made of fiber board or corrugated cardboard with corrugation lines suitably running in the transverse direction. However, if in special cases other properties are very important, the corrugations may instead run in the longitudinal direction.

We claim:

1. A carrier in combination with at least one gabled top package having top surfaces that converge to form a flange, said carrier comprising:

at least six longitudinal sections including two central sections, two intermediate sections and two outer sections, said outer sections being located along opposed edges of said carrier, said central sections being located adjacent one another and between said outer sections, and each one of said intermediate sections being interposed between and connecting one said central section and one said outer section, folding indications being interposed between each adjacent pair of longitudinal sections, said longitudinal sections being folded about said folding indications to form a sleeve with a hollow interior and with said outer sections extending therefrom; and said formed sleeve has a substantially quadrilateral shape transverse cross section, defined by both said central and intermediate sections, with a reference vertex located between said two central sections and an opposed vertex being located between said two intermediate sections, and said formed sleeve being collapsible from an initial position in which said reference vertex is spaced from said opposed vertex by a first distance, to a collapsed position in which said reference vertex is located adjacent said opposed vertex; and said flange of said at least one gabled top package being interposed between and secured to said outer sections.

2. The combination according to claim 1, wherein each said central section of said carrier has a transverse width which is greater than a transverse width of each of said intermediate sections.

3. The combination according to claim 1, wherein an adhesive is provided between said flange of said at least one gabled top package and an inwardly facing surface of said outer sections of said carrier to secure said carrier to said at least one gabled top package.

4. The combination according to claim 1, wherein said outer sections of said carrier are secured by an adhesive to the converging top surfaces of said at least one gabled top package such that said flange of said at least one gabled top package extends towards the interior of said formed sleeve.

5. The combination according to claim 1, further comprising a plurality of gabled top packages;

wherein said outer sections of said carrier are provided with at least one transverse perforation which extends from the opposed edges of said carrier towards said formed sleeve to subdivide said outer sections into at least two individual sections, each of said individual sections has a longitudinal length which is at least equal to a longitudinal length of said flange of one of said plurality of gabled top packages, and said flange of one of said plurality of gabled top packages is interposed and secured between a pair of opposed individual sections.

6. The combination according to claim 5, wherein said outer sections are each provided with a longitudinal tear line which extends perpendicular to and intersects said at least one transverse perforation, such that each of said plurality of gabled top packages is individually removable from said carrier, along with a corresponding portion of said pair of opposed individual sections, by tearing said carrier along said at least one transverse perforation and said longitudinal tear line.

7. The combination according to claim 5, wherein said at least one transverse perforation extends to said folding indication interposed between said outer and said intermediate sections, such that each of said plurality of gabled top packages is individually removable from said carrier, along with a corresponding said pair of opposed individual sections, by tearing said carrier along said at least one transverse perforation and along said folding indications interposed between each individual section of said corresponding pair of opposed individual sections and said intermediate sections.

8. The combination according to claim 1, further including a trough which has an upper recess with a flat bottom to receive upper sets of gabled top packages, and a lower side provided with convergent surfaces and guide grooves which correspond to top surfaces of lower sets of gabled top packages which have carriers applied thereto;

wherein, when said trough is placed on top of said lower sets of gabled top packages, the formed sleeves of said carriers applied to said lower sets of gabled top packages are compressed such that the reference vertices of said formed sleeves of said carriers applied to said lower sets of gabled top packages are received by said guide grooves.

9. A carrier for at least one gabled top package having top surfaces that converge to form a flange, said carrier comprising:

a substantially flat sheet having folding indications thereon for dividing the flat sheet into at least six longitudinal sections, said six longitudinal sections including two central sections, two intermediate sections and two outer sections, said outer sections being located along opposed edges of said carrier and each having at least one transverse perforation formed therein which extends from said opposed edges of said carrier towards an adjacent intermediate section to subdivide said outer section into at least two individual sections each having a longitudinal length at least equal to a longitudinal length of said flange of said at least one gabled top package, said central sections being located adjacent one another and between said outer sections, and each one of said intermediate sections being interposed between and connecting one said central section and one said outer section, said outer sections further being provided with a longitudinal tear line that intersects with and extends perpendicular to said at least one transverse perforation, each of said longitudinal sections being foldable about said folding indications to form an elongate sleeve, and said two outer sections being suitable for securing said at least one gabled top package to said carrier;

wherein, when said substantially flat sheet is folded to form said sleeve, said formed sleeve has a substantially quadrilateral shape transverse cross section, defined by both said central and intermediate sections, with a reference vertex located between said two central sections and an opposed vertex located between said two intermediate sections, and said formed sleeve is collapsible from an initial position in which said reference vertex is spaced from said opposed vertex by a first distance, to a collapsed position in which said reference vertex is located adjacent said opposed vertex, and a desired number of individual sections are formed in said carrier which corresponds to a desired number of gabled top packages to be carried by said carrier such that, when said substantially flat sheet is folded to form said sleeve and secured to said desired number of gabled top packages:

i) each said gabled top package is secured to said carrier by a pair of opposed individual sections, and said pair of opposed individual sections includes an individual section from each of said outer sections; and ii) each said gabled top package is individually removable from said carrier, along with a corresponding portion of said pair of opposed individual sections, by tearing said carrier along said at least one transverse perforation and said longitudinal tear line.

* * * * *